US005090732A

United States Patent [19]

Kuhns et al.

[11] Patent Number: 5,090,732

[45] Date of Patent: Feb. 25, 1992

[54] INEXPENSIVE LAMINATED UNIVERSAL SALES PRESENTATION OR SECURITY FOLDER HAVING MANY USES

[75] Inventors: Roger J. Kuhns, Lincoln; Timothy S. McLaren, Westford; Robert L. Nathans, Billerica; Robert F. Smith, Danvers, all of Mass.

[73] Assignee: Avant Incorporated, Concord, Mass.

[21] Appl. No.: 706,019

[22] Filed: May 28, 1991

Related U.S. Application Data

[62] Division of Ser. No. 529,138, May 14, 1990, Pat. No. 5,042,843.

[51] Int. Cl.[5] ..... B42D 3/00; B42D 15/00; B41L 1/00

[52] U.S. Cl. ..... 281/29; 281/31; 281/35; 283/79; 283/107; 283/109; 283/117; 428/203; 428/204; 462/84

[58] Field of Search ..... 281/15.1, 29, 31, 35, 281/37; 283/72, 79, 80, 81, 107, 109, 117; 428/203, 204, 205, 211, 212, 218; 462/84, 6, 7

[56] References Cited

U.S. PATENT DOCUMENTS

| | | | |
|---|---|---|---|
| 4,121,856 | 10/1978 | Brunette | 283/81 X |
| 4,121,961 | 10/1978 | Brunette et al. | 283/81 X |
| 4,386,795 | 6/1983 | Charles et al. | 283/81 X |
| 4,407,524 | 10/1983 | Trautlein | 283/79 X |
| 4,496,961 | 1/1985 | Devrient | 283/72 X |
| 4,892,335 | 1/1990 | Taft | 283/109 X |
| 4,932,681 | 6/1990 | Wörndli | 283/72 X |
| 4,951,970 | 8/1990 | Burt | 283/79 X |
| 4,971,361 | 11/1990 | Whiting | 281/15.1 X |

*Primary Examiner*—Paul A. Bell
*Attorney, Agent, or Firm*—Robert L. Nathans

[57] ABSTRACT

A single configuration presentation folder is provided, enabling a user to heat laminate custom printed sheets to the face of the folder without the use of a conventional paper carrier. Portions of the folder are scored to produce folders with one or two pouches holding sales literature or pouchless versions for stand-up displays, or folders containing saddle-stitched data sheets therein or laminated data sheets mounted within a loose leaf or spiral bound cover. Various arrays of fiducials are provided for enabling easy, accurate manual positioning of variable sized insert sheets with respect to the folder edges. The fiducials may be made to disappear upon lamination or are otherwise visually non-obtrusive to the eye. The fiducials may consist of disappearing ink, readily releasable adhesive, grid lines formed in the heat activatable adhesive of the cover sheet, indentations in the folder or inks having low visual contrast. Warpage is prevented by the use of a special plastic backing sheet and a secured file using carbonless paper thwarts fraudulent compromise of critical data therein.

41 Claims, 3 Drawing Sheets

INEXPENSIVE LAMINATED UNIVERSAL SALES PRESENTATION OF SECURITY FOLDER HAVING MANY USES

BACKGROUND OF THE INVENTION

This application is a division of application Ser. No. 07/529,138, filed May 14, 1990, now U.S. Pat. No. 5,042,843.

The present invention relates to the field of laminated plastic display devices and includes display devices for use in marketing goods and services.

A common type of presentation folder is made of rectangular paper stock having a thickness of about ten mils. A centrally positioned vertical fold separates a left half portion from a right half portion, at least one portion having a pouch formed at the bottom of the folder for containing sales literature and the like. Customized indicia such as a company logo and a description of the literature within the folder and related information is sometimes printed on the front cover of the folder by a print shop. Sending the folder to an outside print shop can result in detrimental delays and furthermore is costly, particularly if only small numbers of folders are to be printed.

We thus designed a presentation folder whereby a thin sheet of such customized indicia, which can be quickly and economically produced by a desk top publishing PC program, is heat laminated to the front face of the folder.

During the development of the new presentation folder having a transparent plastic front cover sheet to be economically laminated to a custom printed insert sheet and the front face of the folder, we wished to cut the 9 by 11.5 inch plastic cover sheet from a common type of economical heat activatable plastic roll stock. From the roll stock we produced cut sheets, which after being heat laminated to the custom printed insert sheet and the front face of the folder, produced a warped or bowed front face of the file folder. This was unacceptable from an aesthetic point of view, particularly where the sales literature is used in selling expensive items.

We also desired to provide users with folders which could have one or alternatively, two pouches for containing the sales literature, or no pouches in a third version, whereby sales literature could be saddle stiched or stapled to the vertical centralized fold separating the two halves of the folder. In a fourth version, customized printed sheets would be laminated by the user to one or both halves of the folder to produce a stand up display. In a fifth version, the customer would utilize one half of the folders to produce separate laminated sheets of sales literature which would be mounted in a spiral bound or loose leaf notebook.

However, should a user wish to have a number of different types of folders on hand to make the different versions of the display, this could produce inventory control problems, particularly if a user doesn't require large quantities of folders. That is, if only a small quantity of materials to make the various versions are stocked at one time, the small user could easily run out of those folders for making particular desired versions of the display, just when the saleman needs them.

During prior art roll lamination, a paper carrier encloses the plastic sheets as they pass through the hot rolls of the laminator. These carriers spread the heat and pressure over a wider area of the sheets being laminated as they pass through the bite of the roller pair.

The result is a more uniform lamination. However, some users use the same paper carrier over and over so that they become compressed and lose their ability to efficiently spread the pressure of the roller pair. They can also become contaminated with plastic oozing out of the edges of the plastic envelopes if used repeatedly. Also the carriers are subjected to the same inventory control problems mentioned in the previous paragraph. If the users run out of the carriers, they often use the same remaining carriers over and over, reducing the quality of the laminated product.

It would thus be desirable to prevent the use of old carriers and in effect force the user to use a fresh carrier for each lamination. Additionally, a need exists for a secured file folder for accumulating critical data, such as company personnel or drug use data, which cannot be compromised by dishonest individuals.

BRIEF SUMMARY OF THE INVENTION

It is thus an object of the present invention to overcome the aforesaid problem of warpage or bowing of large heat activatable inexpensive cut sheets when laminated to the front covers of the folders. This goal was accomplished by heat laminating a second thin and thus inexpensive plastic backing sheet to the inner face of the paper folder, opposite the front face during manufacture of the product. The interesting result is that the user receives a bowed intermediate product which becomes unbowed upon the final lamination of the finished product by the user.

The aforesaid inventory control problem was solved by designing a single universal folder which may be easily and rapidly converted by the user into any of the aforesaid five versions of the display device. Micro-perforated folds are oriented to enable removal of one or both pouch forming flaps to produce the saddle stich version or the stand-up display version or to enable separation of the two halves to implement the loose leaf version. The use of the universal folder also reduces the all important manufacturing costs and inventory control problems at the manufacturing end as well. Also, the aforesaid inventory control problems relating to the paper carriers is eliminated by manipulating the folder during the final lamination step carried out by the user in a manner to eliminate the need for a separate carrier altogether.

In accordance with a further feature of the present invention, a rectangular grid of fiducial lines is formed in the heat activatable adhesive layer on the inside of the transparent cover sheet to enable the person inserting the customized insert sheet between the cover sheet and front face of the folder, to quickly and accurately properly position various sized insert sheets with respect to the edges of the folder, before the plastic cover and insert sheets are laminated to the folder. The grid lines disappear due to the flow of the heat activatable adhesive during lamination.

A possibly less costly approach is to print arrays of small fiducial markings upon the front face of the paper folder sheet which preferably consist of lightly colored L-shaped markings or dots. Such markings could be printed on the paper folder sheet using regular printing inks, or inks which disappear upon being exposed to the heat of lamination. They could also consist of islands of readily releasable pressure sensitive adhesive, or indentations in the paper folder sheet. A secured file uses carbonless paper laminated to the plastic cover or backing sheet, which carbonless paper thwarts compromise of data recorded thereon.

BRIEF DESCRIPTION OF THE DRAWINGS

Other objects, features and advantages of the present invention will become apparent upon reading the following detailed description taken in conjunction with the drawings in which.

DETAILED DESCRIPTION OF EMBODIMENTS OF THE INVENTION

Figure 1:
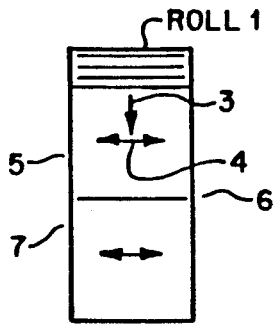
FIG. 1 PRIOR ART
FIG. 1 illustrates the aforesaid prior art plastic stock.

As shown in FIG. 1, plastic roll stock is fed from roll 1 in the direction indicated by arrow 3, and discrete sheets are produced by cutting along line 6. The lateral internal stressing of the plastic to strengthen it is indicated by arrow 4 which probably produced the aforesaid warpage of the front cover of the folder after lamination by the user.

Figure 2:
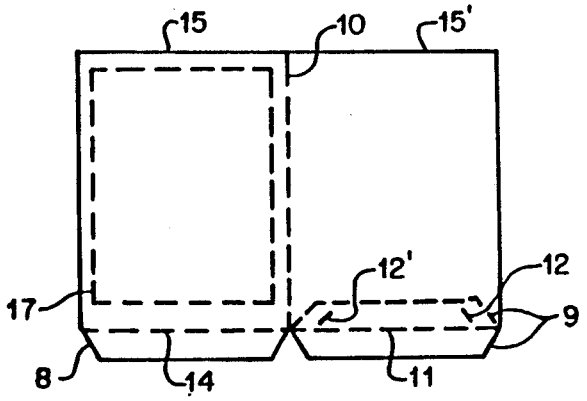
FIG. 2 illustrates the universal paper folder stock.

The basic universal 10 mil paper folder sheet shown in FIG. 2, has a vertically oriented fold 10 which divides a left hand half portion 15 from a right hand half protion 15'. First and second pouch forming flaps 9 and 8 are attached to bottom portions of the folder sheet via score lines 11 and 14 respectively. Fold 10 is also scored in like manner. Preferably, the scoring consists of universally employed micro-perforations, well known in the art, in order to make them virtually invisible, to enhance the appearance of the product.

Figure 6:
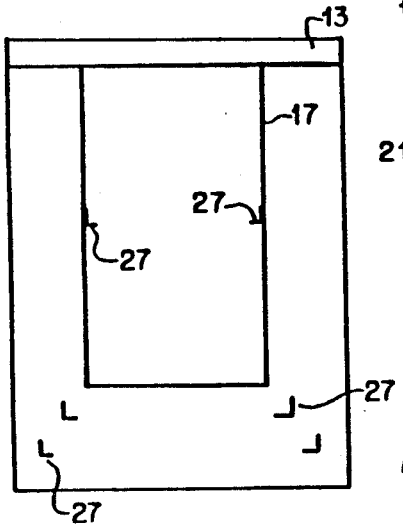
FIG. 6 illustrates a plan view of a portion of the display device said display device being supplied to the user before lamination of the cover sheet and the indicia bearing insert sheet to the left hand front face portion of the paper folder sheet of FIG. 2.
Figure 7:
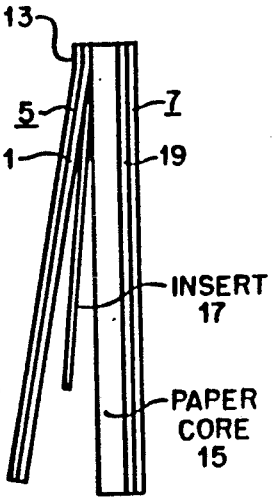
FIG. 7 illustrates a side view of the portion of FIG. 6.

Typically, the left hand major folder portion 15 has a plastic cover sheet 5, heat sealed to a minor folder portion via seal 13 shown in FIGS. 6 and 7. A custom printed insert sheet 17 is positioned by the user between heat activatable portion 21 of the plastic cover sheet and the front face of the left hand portion of the paper folder sheet. The user thereafter laminates the cover sheet 5 to the insert sheet 17 and the border portions of the paper folder sheet 15 surrounding the insert sheet. The user employs an inexpensive conventional roll laminator for applying heat and pressure to perform the final lamination step. Typical applied temperatures are about 215 degree F., and the twelve inch laminate passes through the roll laminator in about thirty seconds.

The nature and function of the backing sheet 7, which is prelaminated to the back of the core or folder sheet, before being shipped to the user, will now be described. In our early experiments, we attempted to laminate the plastic cover sheet to the front face of the folder sheet, with the insert sheet between the two. The folder, after lamination, would usually be drastically warped and looked something like the bowing of the roof of a quonset hut and the resulting finally laminated product would be unacceptable to the user, particularly if the folder was to contain sales literature for selling high priced products or services.

We believe that this warpage was dominantly due to irreversible shrinkage bi-axially of about 1.5% during lamination of the cover sheet to the folder at about 150 degrees C. This is due to intentional stressing of the polyester terepthalate plastic sheets during manufacture in order to strengthen them. This stressing causes a residual permanent shrinkage of 1/6 and ⅛ of an inch in the laminating machine sheet feed direction and the transverse direction orthogonal thereto respectively. (There is also a minor secondary bi-axial counter-distortion of approximately 0.2% due to reversible thermal expansion. However, normal dimensional stability is regained within a few minutes after cooling of the lamination due to this effect.)

In our effort to eliminate this warpage, we then tried applying a backing sheet of the same material but having greater thickness and stiffness than the plastic cover sheet and the laminated product was still warped to an unacceptable extent. We finally laminated a backing sheet to the back or second face of the folder sheet opposite the first or front face, and this backing sheet had the same thickness and was made of the same material as the cover sheet. The result was a warped or bowed product which would be sold to the user. However, the final lamination of the cover sheet to the insert sheet and the folder, by the user, surprisingly resulted in an unwarped, flat acceptable final product.

Also, the paper core or folder sheet often itself becomes bowed when exposed to extremes in humidity. Yet, a flat final laminate was still produced, even when the paper core sheet was substantially bowed.

We also found through experimentation that both plastic sheets should have substantially the same physical characteristics, e.g. thickness and prestressing. Our experiments also indicate that if the thickness of the backing sheet varied more that plus or minus 25% of the thickness of the cover sheet, that the most desired degree of flatness of the final laminate was not obtained. Also, since the relatively thin and thus inexpensive plastic sheets solved the warpage problem which occurs during the above described sequential lamination process, we prefer to employ a one mil thick polyester terephthalate (polyester) base stock bearing about two mils of polyethylene heat activatable adhesive, for a total thickness of about three mils.

In summary, heat activatable layers 19 and 21 shown in FIG. 7, were of polyethylene upon a "Mylar" polyester plastic base. Each plastic sheet that we used had a total thickness of about three mils; where the polyethylene had a two mil thickness. Each sheet was thus thin relative to the relatively thick paper folder or core sheet 15 which had a thickness of about ten mils. Thus the backing sheet did not function to prevent warpage merely by stiffening the folder by virtue of its stiffness. To the contrary, the backing sheet was far thinner than ten mils and was less stiff than the paper folder sheet. Accordingly, the additional lamination of the thin plastic backing sheet at the factory, to major portions of the folder or core sheet produced the unexpected result of eliminating the warpage or bowing, of the final laminated folder, which would otherwise be produced by the lamination of the cover sheet to the paper folder or core sheet in the absence of the backing sheet. Also, the employment of this thin plastic sheet rather than thick stiff backing sheets greatly reduces the all important manufacturing costs. The upper and side edges of both plastic sheets and the folder sheet are preferably congruent.

The universal nature of our presentation folder will now be described. In FIG. 2, the inside portions of the folder face the reader and thus the laminated insert sheet 17 is shown by dotted lines. Should the user wish to have two pouches for holding the sales literature, flaps 8 and 9 are folded upwardly and are affixed to the inside folder sheet halves by staples 12 and 12' or by tape or the like. If the user wishes to have a one pouch version, the second flap, eg. 8 would be folded and manually separated from the folder owing to the aforesaid scoring formed within the folds.

Figure 3:
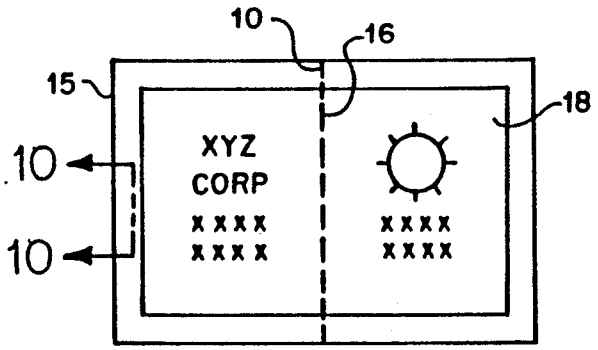
FIGS. 3, 4, and 5 illustrate the aforesaid third, fourth and fifth versions of the user produced display product respectively.

In the third no pouch version of FIG. 3, both flaps are manually removed and double sized sheets of sales literature 18 may be saddle stiched via stiching 16 to the vertical fold 10 in a conventional manner, using staples or otherwise.

Figure 4:
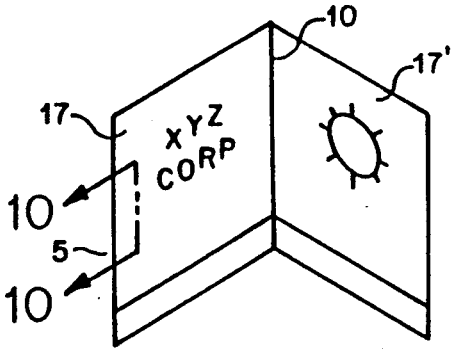

In the fourth no pouch version, we could modify our product supplied to the user by duplicating the above described laminating structure of FIG. 7 upon the right hand folder portion 15'. The user then laminates two insert sheets 17 and 17' to the paper folder and then folds the product along fold line 10 to create a free standing display shown in FIG. 4. Should only one insert be required, our previously unmodified folder would be used for the fourth version also. A stabilized base for the folder may be formed by folding flaps 8 and 9 until they are at right angles to the lower portions of the folder. The folder is now folded about fold 10 to form a desired acute, right or obtuse angle between the folder halves, and the perpendicular flaps are stapled, taped, or otherwise affixed or held together to maintain the selected angle while at the same time, forming a more stabilized base.

Figure 5:
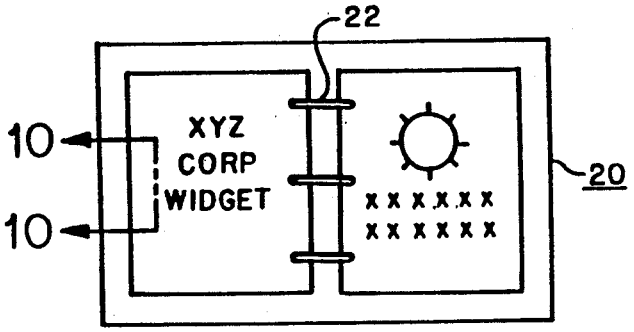
Figure 10:
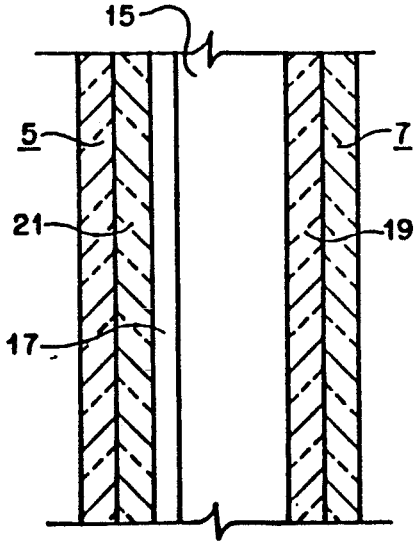
FIG. 10 is a partial cross sectional view taken along 10—10 of the user produced laminated products of FIGS. 3-5.

In the fifth version, the user can use the unmodified folder to produce separate laminated sheets of sales literature. After lamination of the indicia bearing insert sheet to the folder, flap 8 is manually removed and the user manually separates the laminated left half from the unlaminated right half by virtue of the score lines in vertical fold 10, and discards the separated right half, or uses it for another purpose such as a non-plastic presentation folder. The resulting laminated sheet can thereafter be punched and mounted upon rings 22 of ring binder 20 as shown in FIG. 5, and this process is repeated for each customized laminated sheet being made. FIG. 10 is a partial cross section of the aforesaid final user created laminated plastic products taken along sectional lines 10—10 of FIGS. 3-5. The layers illustrated correspond to those previously described in connection with FIGS. 6 and 7.

In the preferred method of final lamination by the user, the insert sheet 17 is inserted between the cover sheet and the folder and the double sized folder is folded about the cover sheet (via fold 10), causing the folder to enclose the cover sheet. The resulting "sandwich" is thereafter passed through the roll laminator and the paper folder sheets enclosing the cover sheet function effectively as a paper carrier, discussed above. The beneficial results include elimination of the need for separate prior art paper carriers with their previouly described drawbacks.

Figure 8:
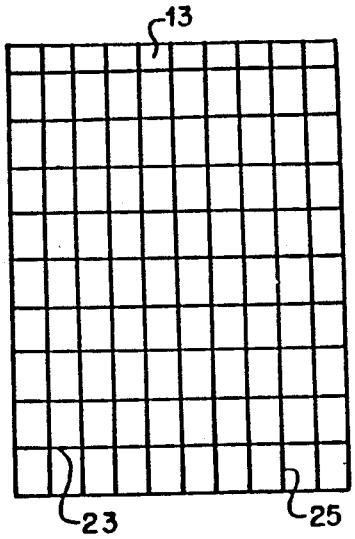
FIG. 8 illustrates an insert sheet positioning grid pattern formed in the heat activatable portion of the plastic cover sheet which disappears after heat and pressure lamination.

The insert sheet positioning fiducial markings mentioned above, could comprise a first set of straight lines 25 and a second set of straight lines 23 perpendicular to the first set as shown in FIG. 8. These lines are formed in the heat activatable layer 21 of the cover sheet 5. They may be produced by a roller die impressing the lines into the heat activatable layer of an entire roll of plastic stock. All of the sheets cut from this roll are used for the cover sheets, whereas a second roll not having the lines enscribed therein is used to make the backing sheets during manufacture of the product.

Just before lamination of the final product by the user, the custom printed insert sheet 17 shown in FIG. 7, may be inserted into the envelope until the leading edge abuts heat seal 13, and the insert sheet is laterally shifted until the side edges of the insert sheet are coincident with, or parallel with respect to, a pair of vertical fiducial lines 25 of FIG. 8. This step is used to provide parallelism between the insert sheet and edges of the paper folder and, if desired, equal left and right side borders about a centrally positioned insert sheet. The top edge of the insert sheet may be positioned against heat seal 13 or could be aligned with a pair of horizontal fiducial lines 23 for any desired vertical positioning, centralized or non-centralized. Since the insert sheet edges will often be surrounded by one or more pairs of grid lines, it is desirable from as aesthetic point of view that they disappear after heat lamination of the insert to the cover sheet. Thus the grid lines are formed in the heat activatable adhesive layer 21.

However, since the paper folder sheet will usually be white, there may be insufficient visual contrast between the white fiducial lines in the plastic and the folder sheet, which could make alignment of the insert sheets with the fiducials somewhat difficult, at least for some users.

Thus, it may be preferable to print the fiducial markings upon the front surface of the paper folder sheet 15. Since the plastic cover sheet 5 is transparent, they may be readily viewed by the user during insert positioning. A possible drawback however, is that normal printing would not disappear after lamination so that somewhat unaesthetic markings would remain visible through the transparent cover sheet. We minimize this effect by ink printing arrays of small L shaped fiducials, enabling the user to position corners of the various sized insert sheets coincident with a selected pair of L shaped fiducials 27 shown in FIG. 6. The L shaped fiducials also are of a color having a low visual contrast with respect to the light background color of the paper core sheet. For example, where the paper core sheet is white, which is generally the case, the fiducials could have a light pink, yellow or blue color.

Figure 9:
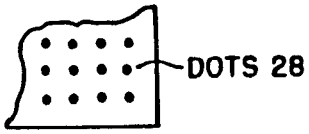
FIG. 9 illustrates a rectangular grid array of dot fiducial markings.

Lightly colored rectangular grids of dots 28, shown in FIG. 9, could be printed with conventional printing inks upon the paper folder sheet along with the L-shaped fiducials or in place of them. Such dots are highly useful to align the insert sheet edges parallel to the envelope edges. Also, "wall paper" grid of lightly colored dots, remaining after lamination, would not be as visually obtrusive as grids of lines (FIG. 8) or L-shaped fiducials. Since they are used primarily for insert edge alignment with respect to the folder edges, exact positioning of the lines of dots on the paper folder sheet with respect to the core sheet edges is not required. This could, eliminate printing registration problems and thus save manufacturing costs.

Ideally, the fiducials would disappear after lamination. It may be economical to print the fiducials on paper folder sheet 15, preferably after lamination of the backing sheet, with an ink which disappears upon being exposed to the heat of lamination. U.S. Pat. No. 4,188,139 to Pasini et al. entitled "Apparatus for Correctably Printing Characters with Subliminal Ink" discloses an ink for this purpose.

Another design approach is to print arrays of small fiducials. e.g. dots, upon the paper folder sheet using readily releasable pressure sensitive adhesive in place of printer's ink. Such "weak" adhesive is currently used in "Post-It" sheets made by 3M corporation. The insert sheets may be applied and removed from the folder surfaces several times without destroying the adhering ability of the adhesive. The edges of the insert sheets may be aligned with a linear array of such fiducials (or the envelope edges) and pressed over a second, more centralized linear array, which will maintain the proper position of the insert sheet with respect to the envelope edges during handling before lamination. If the initial alignment attempt results in non-parallelism, the user merely separates the insert sheet from the adhesive dots and tries again for proper positioning of the insert sheet.

The presently most preferred method of forming the fiducials employs shallow but visible fiducial indentations or impressions formed in the relatively thick (e.g. 10 mil) paper core sheet.

The flow of pressurized heat activatable adhesive over the indentations (surrounding the inset sheet) during heat and pressure of lamination makes them less visible or even causes them to disappear. Forming the L shaped indentations in the paper folder would be part of the same die-cutting operation which cuts out the folder from the paper roll stock, and creates the micro-perforated score lines upon manufacture of the folder. This would entail no additional labor cost and has the added advantage that the fiducial indentations would always be accurately in registration with the folder edges for proper placement thereof on the folder. We found that we could not make the indentations fully disappear upon lamination, as we prefer, unless the structured polyester terephthalate/polyethylene sheets had a rather thick and stiff polyester layer of four mils minimum, the polyester thus acting as a platen, and unless there is sufficient thermal polyethylene adhesive to flow freely around the indentations and thus the adhesive thickness should be six mils minimum. The indentations in the paper core and folder sheet preferably have a depth of about one mil.

The presentation folders described above may also be utilized to make secured files. For example, employees have been known to gain access to their personnel files and fraudulently and readily change data therein such as their educational degree, company title and salary to obtain monetary advantage. This practise may be thwarted by laminating a first sheet bearing key portions of this critical data between the plastic cover sheet 15 and the front face of the folder. To increase security, this sheet could have numerous company logos lightly printed thereon. Updated data is printed on a second sheet from time to time; e.g. salary increases and new educational degrees. Such updated data is produced on a second sheet which is laminated between the plastic backing sheet and the rear face of the folder sheet. The updated data is added by the company from time to time, but importantly, a dishonest employee cannot readily compromise the previously recorded data as described above. It would be difficult to alter such data and even more difficult, if not impossible, to erase the data surreptitiously without obliterating it, which would clearly indicate that the data was compromised. Thus, data can be readily added but not erased.

Figure 11:
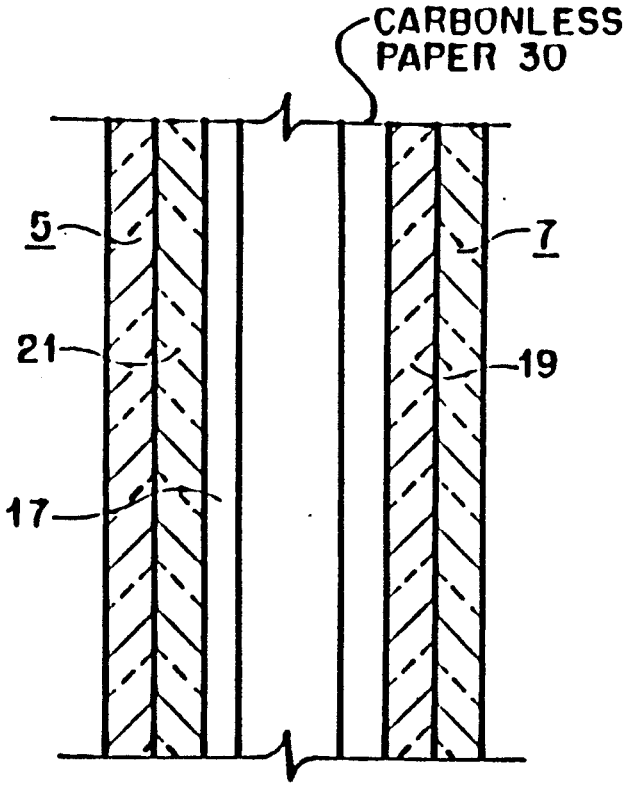
FIG. 11 illustrates lamination of carbonless pressure sensitive paper for producing the aforesaid secured file.

This goal is accomplished in accordance with the present invention be pressure impacting such updated data on carbonless paper 30, shown in FIG. 11, manufactured by 3M and NCR corporations, laminated between the backing sheet and the folder. The carbonless paper contains first and second separated micro-encapsulated dyes within separate encapsulations. Upon pressure impact by a typewriter key for example, the encapsulations are broken, the dyes are combined, and a black or purple letter is produced. A ball point pen, stylus or platen typewriter may be employed for this purpose. The resulting thus secured file folder could also bear the aforesaid pouch containing other sheets bearing less important data. Another beneficial result is that the plastic backing sheet reduces the likelihood of inadvertent scuffing or marking of the now protected carbonless paper. This is because the plastic overlay tends to spread the impact pressure over a wider area over the carbonless paper. Unprotected carbonless paper would be more prone to such inadvertent scuffing.

Similarly secured files may be employed in other applications such as the file of a drug addict under treatment. Updated data could include decreasing drug dosages authorized.

As variations of the above teachings will readily occur to the skilled worker in the art, the scope of the invention is to be defined by the language of the following claims and art recognized equivalents. For example, small circles, triangles or squares may be used in the place of the aforesaid dots or L-shaped markings. In accordance with the doctrine of equivalency, first, second and third major folder portions having up to three flaps and two vertical folds may be provided, and so forth for four or more folder portions. In like manner, the stand-up display can be extended to cover three or four sided displays. While paper is preferred for the folder sheet, such sheet could also be of plastic. Also, the present invention teaches the fabrication of inexpensive plastic envelopes for the lamination of paper inserts for uses other than presentation folders. The term "score line" as used herein, refers to a scored or perforated line, permitting clean folding or separating of the sheet portions.

We claim:

1. A universal folder comprising:

(a) a rectangular folder sheet having a vertically oriented fold extending from a top portion of said folder sheet to a bottom portion of said folder sheet for dividing said folder sheet into a first major portion and a second major portion;

(b) at least one pouch forming flap attached to a bottom portion of said folder sheet via a first score line to facilitate upward folding of said flap to form a pouch or alternatively to enable manual separation of said flap from said folder sheet;

(c) a first light transmissive rectangular plastic cover sheet attached to a minor portion of a face of said folder sheet and having a heat activatable portion facing said folder sheet for enabling a customized insert sheet to be laminated between said plastic cover sheet and said folder sheet.

2. The folder of claim 1 further including a score line formed in said vertically oriented fold to facilitate manual separation of the first and second major portions of said folder sheet from each other if desired.

3. The folder of claim 2 including a second plastic backing sheet heat laminated to major portions of said folder sheet on a face portion of said folder sheet opposite a face portion of said folder sheet facing said plastic cover sheet, said backing sheet having comparable physical characteristics relative to said cover sheet for producing a flat laminated presentation folder.

4. The folder of claim 1 including a second plastic backing sheet heat laminated to major portions of said folder sheet on a face portion of said folder sheet opposite a face portion of said folder sheet facing said plastic cover sheet, said backing sheet having comparable physical characteristics relative to said cover sheet for producing a flat laminated presentation folder.

5. A universal display folder comprising:

(a) a folder sheet having a vertically oriented first score line extending from a top portion of said folder sheet to a bottom portion of said folder sheet for dividing said folder sheet into a first major portion and a second major portion;

(b) at least one pouch forming flap attached to a bottom portion of said folder sheet via a second score line to facilitate upward folding of said flap to form a pouch or alternatively to enable manual separation of said flap from said folder sheet; and (c) a light transmissive plastic cover sheet attached to a face of said folder sheet and having an adhesive portion facing said folder sheet for enabling an indicia bearing insert sheet to be laminated between said light transmissive plastic cover sheet and said folder sheet.

6. The folder of claim 5 wherein first and second pouch forming flaps are attached to bottom portions of said first and second major portions of said folder sheet respectively, via a second score line.

7. The folder of claim 6 further including a score line formed in said vertically oriented fold to facilitate manual separation of the first and second major portions of said folder sheet from each other if desired.

8. The folder of claim 7 including a second plastic backing sheet heat laminated to major portions of said folder sheet on a face portion of said folder sheet opposite a face portion of said folder sheet facing said plastic cover sheet, said backing sheet having comparable physical characteritic relative to said cover sheet for producing a flat laminated folder.

9. The folder of claim 6 including a second plastic backing sheet heat laminated to major portions of said folder sheet on a face portion of said folder sheet opposite a face portion of said folder sheet facing said plastic cover sheet, said backing sheet having comparable physical characteristics relative to said cover sheet for producing a flat laminated presentation folder.

10. The folder of claim 5 including a plastic backing sheet heat laminated to said folder sheet on a face portion of said folder sheet opposite a face portion of said folder sheet facing said light transmissive plastic cover sheet, said backing sheet having physical characteristics which produce substantial bowing of said backing sheet and said folder sheet after said backing sheet and said folder sheet are laminated together by the application of heat and pressure thereto and wherein said adhesive portion of said light transmissive cover sheet is heat activatable and wherein said light transmissive plastic cover sheet has physical characteristics which would produce substantial bowing of said light transmissive cover sheet after being laminated to said folder sheet in the absence of said backing sheet.

11. The folder of claim 10 wherein said light transmissive plastic cover sheet has an approximate size at least as great as a file folder when folded.

12. The folder of claim 11 wherein said light transmissive plastic cover sheet and said plastic backing sheet are congruent.

13. The folder of claim 10 wherein said light transmissive plastic cover sheet and said plastic backing sheet are congruent.

14. The folder of claim 10 including insert positioning fiducial markings indented in said folder sheet, enabling said fiducial markings to disappear due to the flow of heat activatable adhesive produced while heat laminating said plastic cover sheet to said folder sheet.

15. The folder of claim 14 wherein said fiducial markings are L-shaped.

16. The folder of claim 14 wherein said cover sheet is made of structured plastic having a polyester base layer and a heat activatable adhesive layer thereon, the polyester base layer having a minimum thickness of four mils, and the adhesive layer having a minimum thickness of six mils.

17. The folder of claim 10 including an array of indented fiducial markings in the heat activatable adhesive portion of said cover sheet, enabling said fiducial markings to disappear due to adhesive flow upon heat laminating said cover sheet to said folder sheet.

18. The folder of claim 17 wherein said array of fiducial markings are formed in a rectangular grid configuration.

19. The folder of claim 18 wherein said fiducial markings comprise two set of straight lines perpendicular to each other.

20. The folder of claim 18 wherein said fiducial markings are dots.

21. The folder of claim 7 wherein said fiducial markings are L-shaped, enabling their alignment with lower corner portions of customized insert sheets.

22. The folder of claim 10 including heat seal means for joining said cover sheet to said folder sheet adjacent upper congruent edges thereof, and further including fiducial markings spaced from said heat seal by a distance equal to the height of customized insert sheets, whereby the top edge of a customized insert sheet is positioned adjacent said elongated heat seal and said customized insert sheet is laterally shifted until side edges thereof are coincident with a fiducial marking to provide proper lateral positioning of said insert sheet with respect to edge portions of said folder sheet.

23. The folder of claim 22 wherein said fiducial markings are L-shaped.

24. The folder of claim 10 further including insert sheet positioning fiducial markings printed upon portions of said folder with an ink which substantially disappears upon the application of heat thereto during heat lamination of said plastic cover to said folder sheet.

25. The folder of claim 5 including an array of insert sheet positioning fiducial markings printed upon folder sheet and which are small in size so as to be visually non-obtrusive.

26. The folder of claim 25 wherein said fiducial markings are of a color having a low visual contrast with respect to the color of said folder sheet.

27. The folder of claim 26 wherein said fiducial markings comprise a rectangular array dots.

28. The folder of claim 25 wherein said fiducial markings are L-shaped, enabling their alignment with lower corner portions of customized insert sheets.

29. The folder of claim 5 wherein said folder sheet has fiducial markings thereon consisting essentially of readily releasable pressure sensitive adhesive.

30. A method of utilizing a universal display folder comprising:

(a) providing said universal display folder which comprises:

(a-1) a folder sheet having a vertically oriented first score line extending from a top portion of said folder sheet to a bottom portion of said folder sheet for dividing said folder sheet into a first major portion and a second major portion;

(a-2) at least one pouch forming flap attached to a bottom portion of said folder sheet via a second score line to faciliate upward folding of said flap to form a pouch or alternatively to enable separation of said flap from said folder sheet; and (a-3) a light transmissive plastic cover sheet attached to a face of said folder sheet and having an adhesive portion facing said folder sheet for enabling an indicia bearing insert sheet to be laminated between said light transmissive plastic cover sheet and said folder sheet;

(b) upwardly folding said flap about said second score line;

(c) affixing said flap to said folder sheet to form a pouch; and (d) laminating an indicia bearing insert sheet between said light transmissive plastic cover sheet and said folder sheet.

31. A method of utilizing a universal display folder comprising:

(a) providing said universal display folder which comprises:

(a-1) a folder sheet having a vertically oriented first score line extending from a top portion of said folder sheet to a bottom portion of said folder sheet for dividing said folder sheet into a first major portion and a second major portion;

(a-2) at least one pouch forming flap attached to a bottom portion of said folder sheet via a second score line to facilitate upward folding of said flap to form a pouch or alternatively to enable separation of said flap from said folder sheet; and (a-3) a light transmissive plastic cover sheet attached to a face of said folder sheet and having an adhesive portion facing said folder sheet for enabling an indicia bearing insert sheet to be laminated between said plastic cover sheet and said folder sheet;

(b) separating said flap from said folder sheet along said second score line;

(c) laminating an indicia bearing insert sheet between said light transmissive plastic cover sheet and said folder sheet; and (d) separating the first major portion of said folder sheet from the second major portion of said folder sheet along said first score line to form a unitary plastic laminate.

32. The method of claim 31 including the step of punching at least one aperture in the unitary plastic laminate produced in accordance with step (d) and utilizing said aperture to mount said unitary plastic laminate upon a ring binder.

33. Method of utilizing a universal display folder comprising:

(a) providing said universal display folder which comprises:

(a-1) a folder sheet having a vertically oriented first score line extending from a top portion of said folder sheet to a bottom portion of said folder sheet for dividing said folder sheet into a first major portion and a second major portion;

(a-2) at least one pouch forming flap attached to a bottom portion of said folder sheet via a second score line to facilitate upward folding of said flap to form a pouch or alternatively to enable separation of said flap from said folder sheet; and (a-3) a light transmissive plastic cover sheet attached to a face of said folder sheet and having an adhesive portion facing said folder sheet for enabling an indica bearing insert sheet to be laminated between said plastic cover sheet and said folder sheet;

(b) inserting said indicia bearing sheet between said light transmissive plastic cover sheet and said folder sheet;

(c) folding said folder sheet about said vertically oriented first score line in a direction causing said folder sheet to enclose said plastic cover sheet; and (d) laminating said indicia bearing insert sheet between said light transmissive plastic cover sheet and said folder sheet.

34. The method of claim 33 including separating said flap from said folder sheet along said second score line to provide a no-pouch version of said display folder.

35. The method of claim 34 including separating said first major portion of said folder sheet from said second major portion of said folder sheet along said first score line to provide a unitary plastic laminate.

36. The method of claim 33 including folding said flap upwardly about said second score line and thereafter attaching said flap to a face of said folder not facing said light transmissive plastic cover sheet.

37. A method of utilizing a universal display folder comprising:

(a) providing said universal display folder which comprises:

(a-1) a folder sheet having a vertically oriented first score line extending from a top portion of said folder sheet to a bottom portion of said folder sheet for dividing said folder sheet into a first major portion and a second major portion;

(a-2) at least one pouch forming flap attached to a bottom portion of said folder sheet via a second score line to facilitate upward folding of said flap to form a pouch or alternatively to enable separation of said flap from said folder sheet; and (a-3) a light transmissive plastic cover sheet attached to a face of said folder sheet and having an adhesive portion facing said folder sheet for enabling an indicia bearing insert sheet to be laminated between said plastic cover sheet and said folder sheet;

(b) separating at least one flap from said folder sheet along said second score line; and (c) laminating an indicia bearing insert sheet between said light transmissive plastic cover sheet and said folder sheet.

38. The method of claim 37 including the step of stiching double sized indicia bearing sheets to said first vertically oriented score line.

39. The method of claim 37 including the step of folding said folder sheet about said first vertically oriented score line to produce a free-standing display.

40. A method of utilizing a universal display folder comprising:

(a) providing said universal display folder which comprises:

(a-1) a folder sheet having a vertically oriented first score line extending from a top portion of said folder sheet to a bottom portion of said folder sheet for dividing said folder sheet into a first major portion and a second major portion;

(a-2) at least two flaps attached to a bottom portion of said folder sheet via a second score line; and (a-3) a light transmissive plastic cover sheet attached to at least one face of said folder sheet and having an adhesive portion facing said folder sheet for enabling an indicia bearing insert sheet to be laminated between said plastic cover sheet and said folder sheet;

(b) laminating an indicia bearing insert sheet between said light transmissive plastic cover sheet and said folder sheet to form a unitary plastic laminate;

(c) folding said flaps about said second score line until said flaps are at right angles to said folder sheet; and (d) affixing said flaps to each other to form a stable base for a stand-up display.

41. A method of utilizing a universal display folder comprising:

(a) providing said universal display folder which comprises:

(a-1) a folder sheet having a vertically oriented first score line extending from a top portion of said folder sheet to a bottom portion of said folder sheet for dividing said folder sheet into a first major portion and a second major portion;

(a-2) at least one pouch forming flap attached to a bottom portion of said folder sheet via a second score line to facilitate upward folding of said flap to form a pouch or alternatively to enable separation of said flap from said folder sheet; and (a-3) a light transmissive plastic cover sheet attached to a face of said folder sheet and having an adhesive portion facing said folder sheet for enabling an indicia bearing insert sheet to be laminated between said light transmissive plastic cover sheet and said folder sheet; and (b) laminating an indicia bearing insert sheet between said light transmissive plastic cover sheet and said folder sheet.

* * * * *